US006414653B1

(12) United States Patent
Kobayashi

(10) Patent No.: US 6,414,653 B1
(45) **Date of Patent: *Jul. 2, 2002**

(54) DRIVING SYSTEM FOR A PLASMA DISPLAY PANEL

(75) Inventor: Kenichi Kobayashi, Yamanashi-ken (JP)

(73) Assignee: Pioneer Electronic Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/069,213

(22) Filed: Apr. 29, 1998

(30) Foreign Application Priority Data

Apr. 30, 1997 (JP) ..... 9-113189
Oct. 2, 1997 (JP) ..... 9-270222

(51) Int. Cl.[7] ..... G09G 3/28
(52) U.S. Cl. ..... 345/60; 315/169.4
(58) Field of Search ..... 345/60, 66, 68, 345/208–210, 213; 445/24, 25; 324/500; 315/169.1, 169.2, 169.4, 169.3

(56) References Cited

U.S. PATENT DOCUMENTS 5,123,039 A * 6/1992 Shoulders ..... 378/119
5,148,461 A * 9/1992 Shoulders ..... 378/119
5,446,344 A * 8/1995 Kanazawa ..... 315/169.4
5,724,053 A * 3/1998 Nagakubo ..... 345/60
5,790,087 A * 8/1998 Shigeta et al. ..... 345/67
5,818,419 A * 10/1998 Tajima et al. ..... 345/147
5,854,540 A * 12/1998 Matsumoto et al. ..... 315/169.1
5,917,461 A * 6/1999 Sakami et al. ..... 345/29
5,963,184 A * 10/1999 Tokunaga et al. ..... 345/60

* cited by examiner

*Primary Examiner*—Vijay Shankar
*Assistant Examiner*—Vanel Frenel
(74) *Attorney, Agent, or Firm*—Arent Fox Kintner Plotkin & Kahn

(57) ABSTRACT

A plasma display panel has a plurality of row electrodes in pairs, a plurality of column electrodes intersecting with the row electrodes, first driving means for applying a row electrode driving pulse to each of the row electrodes, and second driving means for applying a pixel data pulse to each of the column electrodes. A manual adjusting means is provided for manually adjusting timing of rise edge and/or timing of fall edge of the row electrode driving pulse and/or the pixel data pulse.

7 Claims, 8 Drawing Sheets

DRIVING SYSTEM FOR A PLASMA DISPLAY PANEL

BACKGROUND OF THE INVENTION

The present invention relates to a driving system for a plasma display panel (ACPDP) of a matrix display system.

Recently, as a display device becomes large in size, thickness of the display device is desired to be thin. Therefore, various types of display devices of thin thickness are provided. As one of the display devices, an ACPDP is known.

A conventional an ACPDP comprises a plurality of column electrodes and a plurality of row electrodes formed in pairs and disposed to intersect the column electrodes. A pair of row electrodes form one row (one scanning line) of an image. The column electrodes and the row electrodes are covered by dielectric layers respectively, at a discharge space. At the intersection of each of the column electrodes and each pair of row electrodes, a discharge cell (pixel) is formed.

FIG. 8 shows a timing chart of drive signals for driving the conventional ACPDP.

A reset pulse RPx of negative polarity is applied to each of the row electrodes X1–Xn. At the same time, a reset pulse RPy of positive polarity is applied to each of the row electrodes Y1–Yn. Thus, all of the row electrodes in pairs in the PDP are excited to discharge, thereby producing charged particles in the discharge space at the pixel. Thereafter, when the discharge is finished, wall charge is formed and accumulated on the discharge cell (A reset all at once period).

Here, in order to regulate the discharge and emission of light caused by the reset pulse which has no connection with the display and to improve the contrast, the reset pulses RPx and RPy having long rising time (long time constant) are used.

Then, pixel data pulses DP1–DPn corresponding to the pixel data for every row are applied to the column electrodes D1–Dm in order in accordance with display data. At that time, scanning pulses (selecting and erasing pulses) SP are applied to the row electrodes Y1–Yn in order in synchronism with the timings of the data pulse DP1–DPn.

At the time, only in the discharge cell (non-lighting pixel) to which the scanning pulse SP and the pixel data pulse DP are simultaneously applied, the discharge occurs, so that the wall charge produced at the reset all at once period is erased.

On the other hand, in the discharge cell to which only the scanning pulse SP is applied, the discharge does not occur. Thus, the wall charge produced at the reset all at once period is held. Namely, a predetermined amount of the wall charge is selectively erased in accordance with the pixel data (An address period).

Next, a discharge sustaining pulse IPx of negative polarity is applied to the row electrodes X1–Xn, and a discharge sustaining pulse IPy of negative polarity is applied to the row electrodes Y1–Yn at offset timing from the discharge row pulses IPx.

During the discharge sustaining pulses are continuously applied, the discharge cell which holds the wall charge sustains the discharge and emission of light (A discharge sustaining period). On the other hand, a discharge cell in which the wall charge is erased does not emit.

Then, wall charge erasing pulses EP are applied to the row electrodes Y1–Yn for erasing the wall charges formed in all discharge cells.

By repeating the cycle comprising the reset all at once period, address period, discharge sustaining period, and wall charge erasing period, the pixel display is performed.

As the PDP becomes large and fine, the wiring length of the row electrode is increased, and the width of the electrode is reduced. As a result, the wiring resistance of the electrode increases.

On the other hand, in the discharge sustaining period, a discharge current which flows in the discharge cell becomes maximum after several nanosecond from the start of the discharge sustaining pulse application, thereafter when several hundreds nanosecond elapses, the current stops. Since the interval between the discharge sustaining pulses is several microseconds, if, in selected respective discharge cells on a pair of row electrodes, discharges are approximately simultaneously started, a large discharge current flows instantaneously, which causes a large voltage down, thereby aggravating display characteristic.

In addition, the PDP has a narrow operating range for the driving voltage of the discharge. Therefore, if the DPD becomes large and fine, it is difficult to precisely control and manufacture the shape of the electrode and the thickness of the dielectric layer. Consequently, operating voltage and display characteristics vary at every panel.

SUMMARY OF THE INVENTION

An object of the present invention is to provide a driving system for a plasma display panel which may improve display characteristics in accordance with respective panels, and may adjust each panel to a proper condition.

According to the present invention, there is provided a system for driving a plasma display panel having a plurality of row electrodes in pairs, a plurality of column electrodes intersecting with the row electrodes, first driving means for applying a row electrode driving pulse to each of the row electrodes, and second driving means for applying a pixel data pulse to each of the column electrodes, comprising, manual adjusting means for manually adjusting timing of rise edge and/or timing of fall edge of the row electrode driving pulse and/or the pixel data pulse.

The row electrode driving pulse includes reset pulses applied to the row electrodes in pairs for initializing all pixels, scanning pulses applied to one of the pair of row electrodes in order, discharge sustaining pulses applied to the row electrodes in pairs.

The manual adjusting means is provided for further adjusting a pulse width of the row electrode driving pulse and/or the pixel data pulse.

These and other objects and features of the present invention will become more apparent from the following detailed description with reference to the accompanying drawings.

DETAILED DESCRIPTION OF THE PREFERRED EMBODIMENTS

Figure 1:
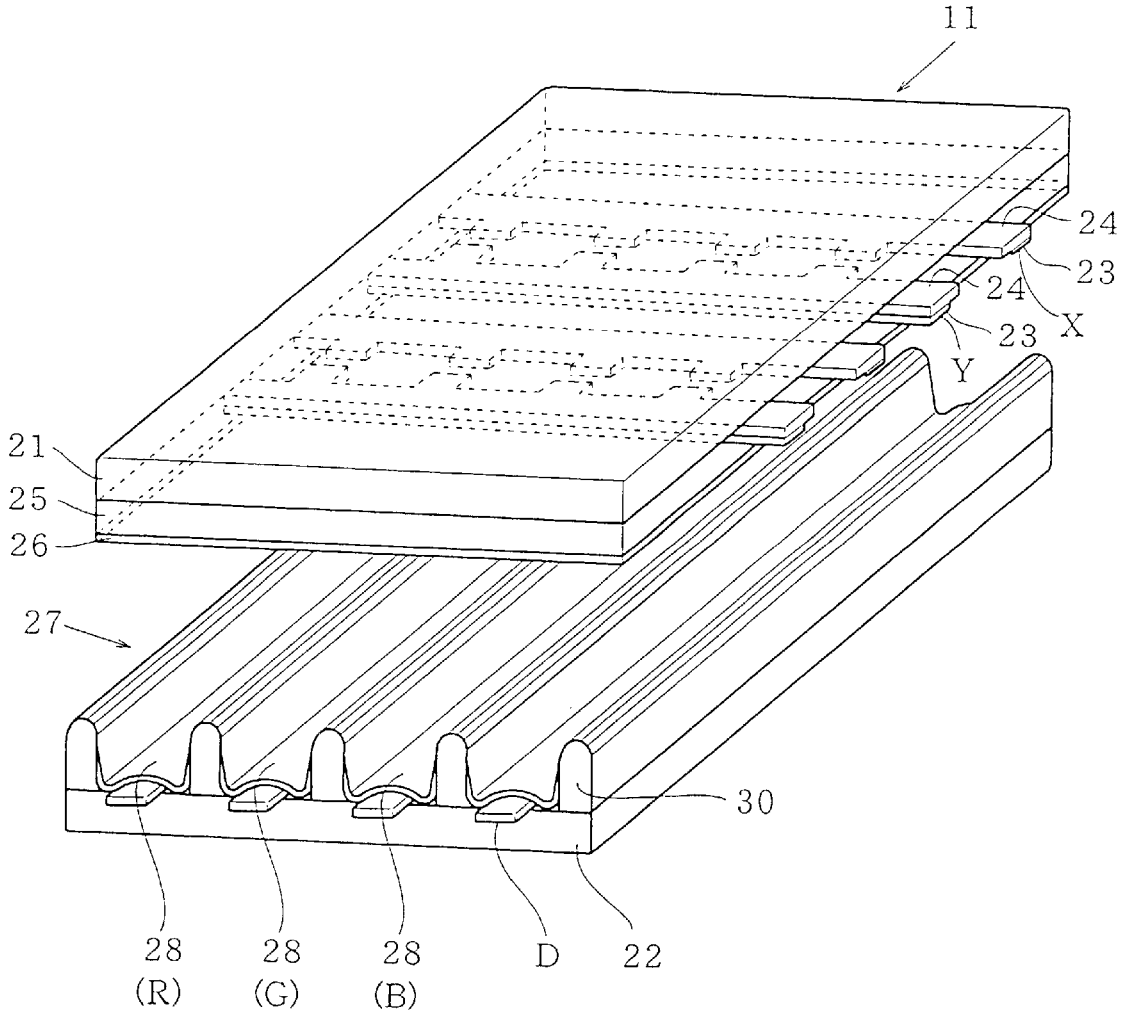
FIG. 1 is a schematic perspective view showing a plasma display panel driven by the present invention.

FIG. 1 shows a PDP of a reflection type to which the present invention is applied. A PDP 11 comprises a pair of glass substrates 21 and 22 disposed opposite to each other, interposing a discharge space 27 therebetween. The glass substrate 21 as a display portion has row electrodes (sustain electrodes) X and Y which are alternately disposed in pairs to be parallel with each other at the inside portion thereof. The row electrodes X and Y are covered by a dielectric layer 25 for producing wall charge. A protection layer 26 made of MgO is coated on the dielectric layer 25.

Each of the row electrodes X and Y comprises a transparent electrode 24 formed by a transparent conductive film having a large width and a bus electrode (metallic electrode) 23 formed by a metallic film having a small width and layered on the transparent electrode 24.

On the glass substrate 22 as a rear member, a plurality of elongated barriers 30 are provided at the inside portion thereof for defining the discharge space 27. The barrier 30 extends in the direction perpendicular to the row electrodes X, Y. Between the barriers 30, column electrodes (address electrodes) D are formed to intersect the row electrodes X and Y of the glass substrate 21. A phosphor layer 28 having a predetermined luminous color R, G or B covers each of the column electrodes D and opposite side portions of the barrier 30. The discharge space 27 is filled with rare gases. Thus, a pixel (including a discharge cell) is formed at the intersection of the row electrodes X and Y on the glass substrate 21 and the column electrode D on the glass substrate 22. Since the PDP having a plurality of pixels is formed, it is possible to display images.

Figure 2:
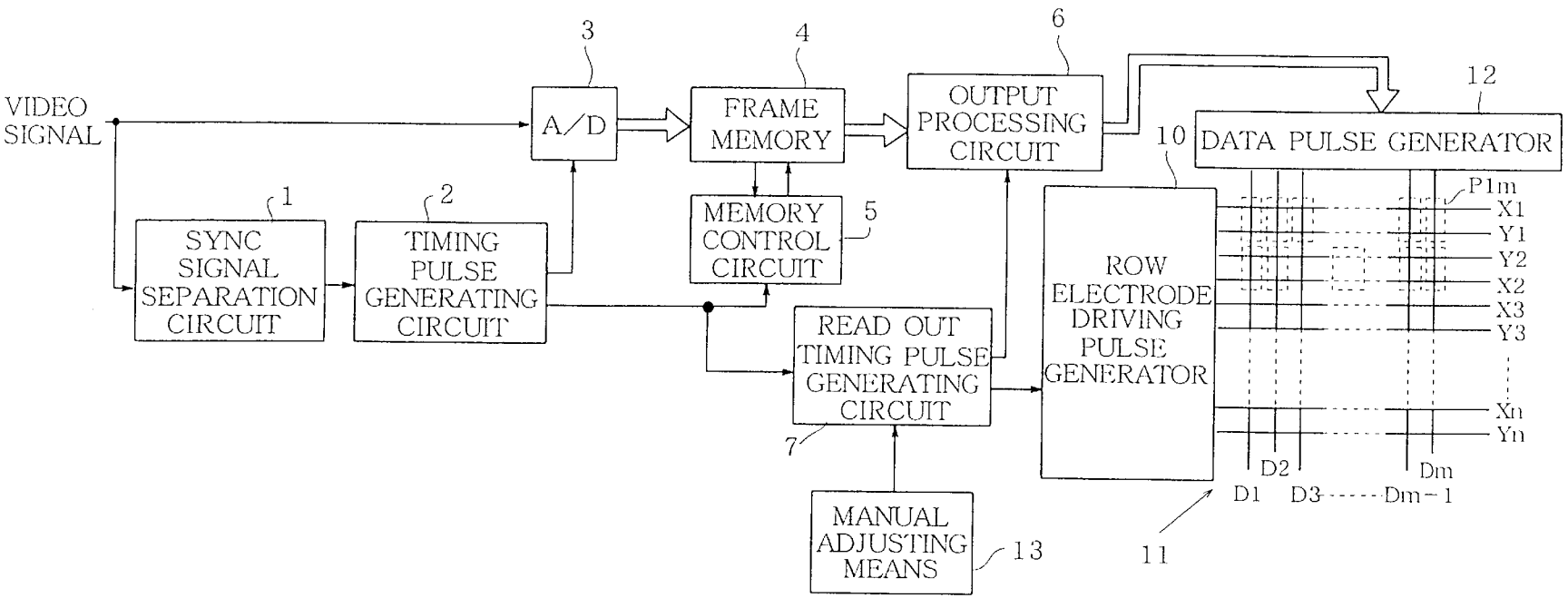
FIG. 2 is a block diagram showing the system of a first embodiment of the present invention.

Referring to FIG. 2, a driving system for a plasma display panel according to a first embodiment of the present invention, the system has a sync signal separation circuit 1 to which an input video signal is applied. The sync signal separation signal 1 operates to extract horizontal and vertical synchronizing signals from the input video signal. The horizontal and vertical synchronizing signals are applied to a timing pulse generating circuit 2 which produces various timing pulses based on the synchronizing signals. The timing pulses are applied to the A/D converter 3 which is operated in synchronism with the timing pulse, so as to convert the input video signal into pixel data for each pixel.

The timing pulses is further applied to a memory control circuit 5 and a read out timing signal generating circuit 7. The memory control circuit 5 produces writing pulses and reading pulses corresponding to the timing pulse from the timing pulse generating circuit 2 and applies the pulses to a frame memory 4. The frame memory 4 stores the pixel data from the A/D converter 3 in order in accordance with the matrix of the panel in response to each writing pulse, and reads the pixel data for applying the data to an output processing circuit 6 in response to the reading pulse.

The output processing circuit 6 is operated to send the pixel data from the frame memory to a pixel data pulse generating circuit 12 of the display panel 11 in synchronism with the timing signal from the timing signal generating circuit 7.

The read out timing signal generating circuit 7 produces a scanning pulse for starting a discharge for emitting light, sustaining pulse for sustaining the emitting of the light and an erasing pulse for stopping the discharge and erasing the light. The scanning, sustaining and erasing pulses are applied to a row electrode driving pulse generating circuit 10 of the display panel 11. The pixel data pulse generating circuit 12 applies pixel data pulses DP to column electrodes D1, D2, D3 . . . Dm−1, and Dm dependent on the pixel data. The row electrode driving pulse generating circuit 10 produces reset pulses PDx and PDy for forcibly causing the discharge between all row electrodes, for generating charge particles in discharge space which will be hereinafter described, priming. pulses PP for causing reformation of charge particles, scanning pulse SP for writing the pixel data, sustaining pulses IPx and IPy for sustaining discharge emission, and an erasing pulse EP for erasing the wall charge. These pulses are applied to the row electrodes X1–Xn and Y1–Yn in accordance with various timing signals fed from read out timing signal generating circuit 7.

In accordance with the present invention, manual adjusting means 13 is provided. The manual adjusting means 13 is arranged so as to manually adjust the generating timing of various timing signal produced from the read out timing signal generating circuit 7 in accordance with characteristics of each plasma display panel at the time when the PDP is shipped. By the manual adjusting means 13, leading edges and/or trailing edges of the row electrode driving pulses and/or data pulses such as the reset pulse, priming pulse, scanning pulse, discharge sustaining pulse and others are shifted, so that row electrode driving pulse and/or pixel data pulse suitable for each PDP may be produced from the row electrode driving pulse generating circuit 10 and/or the pixel data pulse generating circuit 12.

Figure 3:
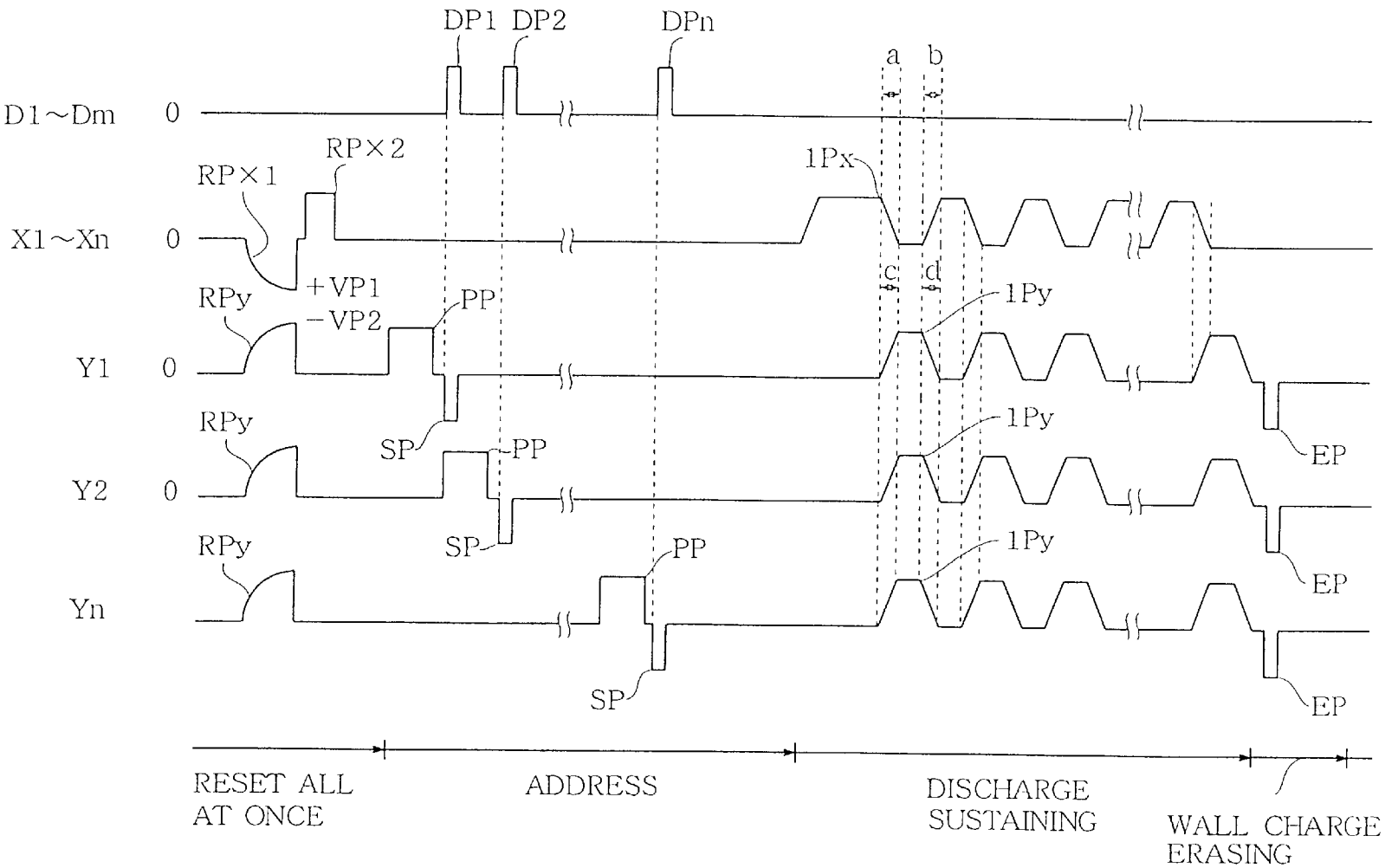
FIG. 3 is time charts showing drive signals for driving the plasma display panel according to a first example.
Figure 4:
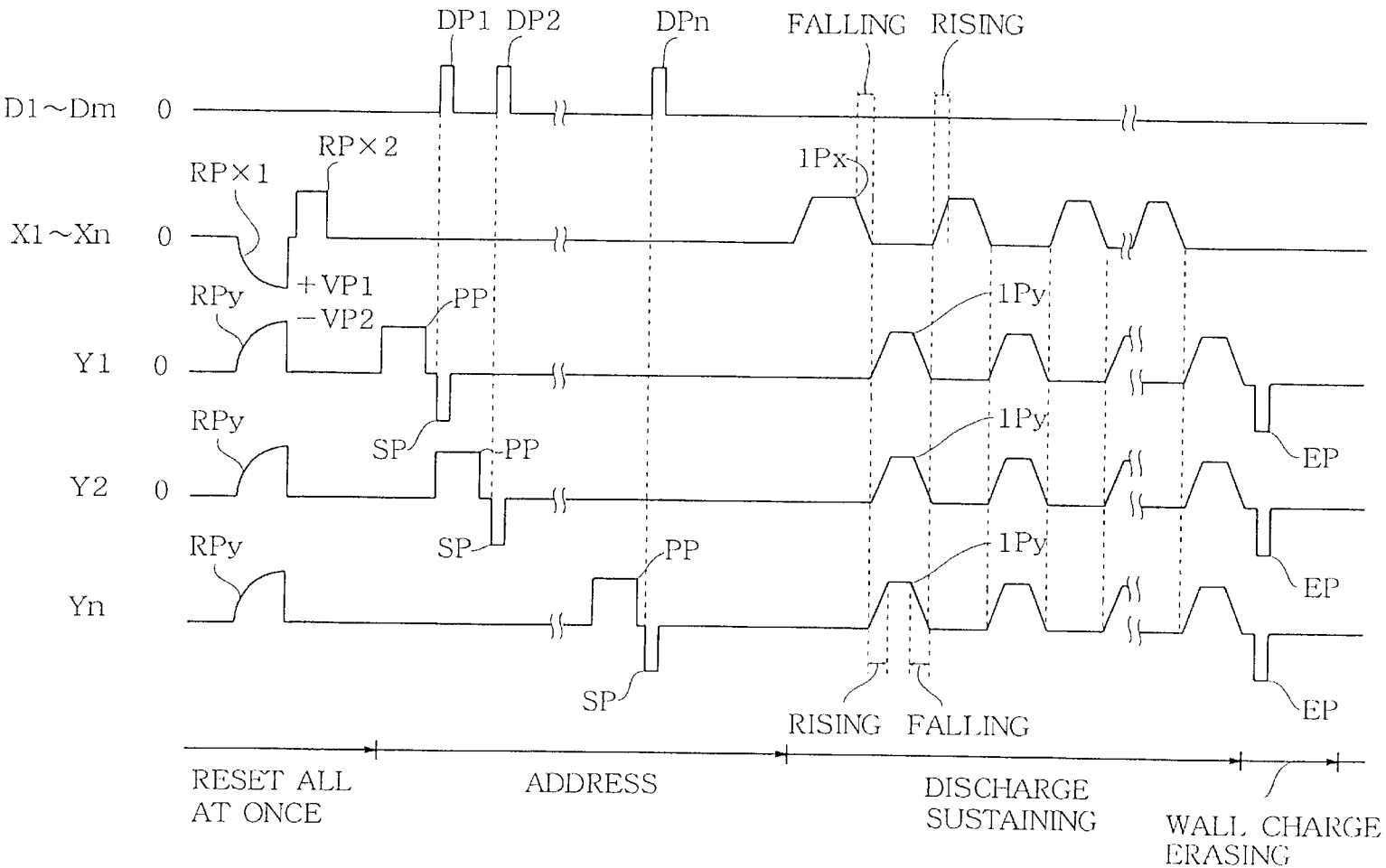
FIGS. 4 and 5 are time charts showing drive signals for a second and third examples of the present invention.
Figure 5:
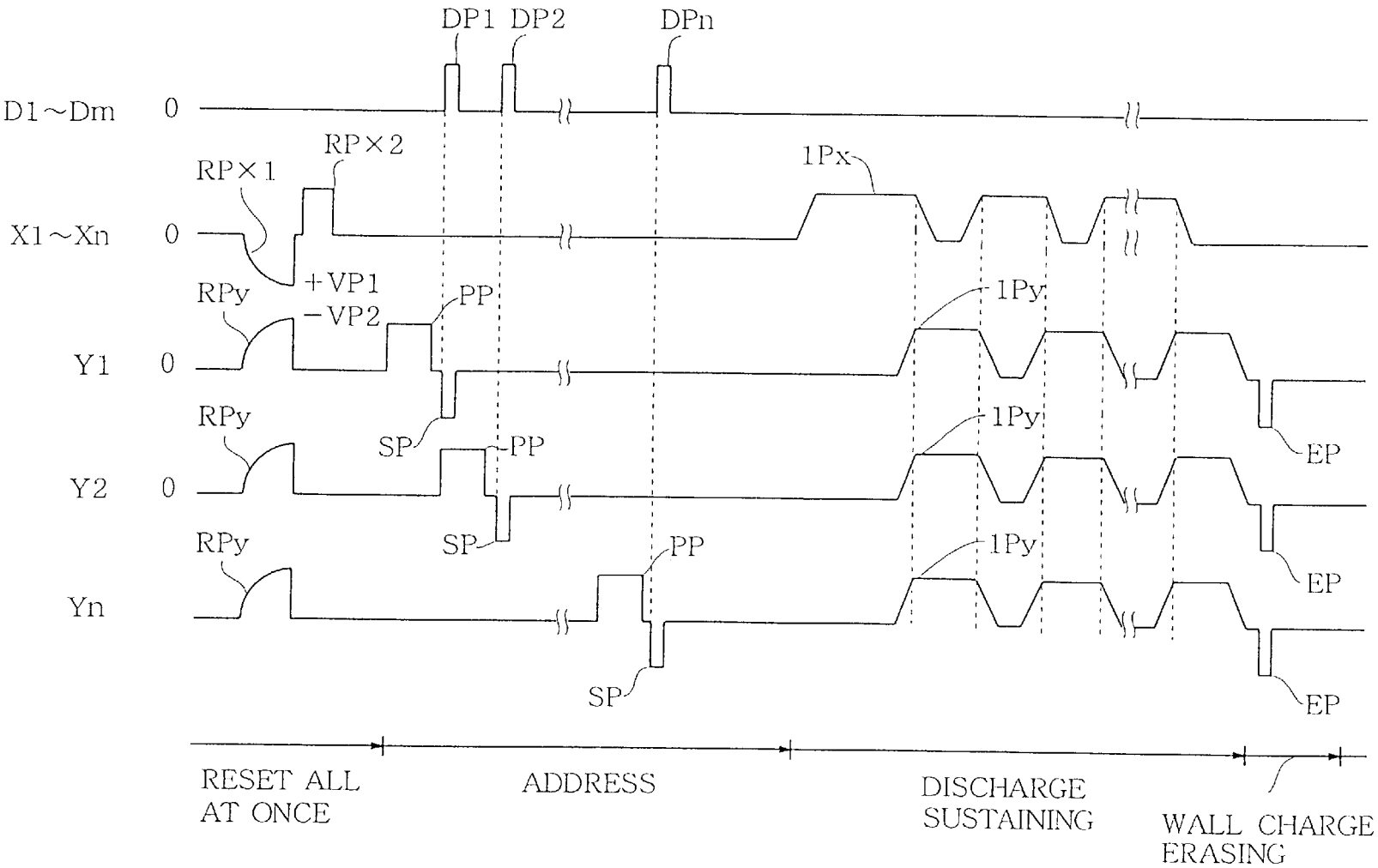

FIGS. 3 to 5 show a first to third driving waveforms in which application timing of each discharge sustaining pulse is adjusted by the manual adjusting means 13.

As shown in the drawings, the PDP 11 is composed such that the display is performed by repeating a sub-frame comprising the reset period, address period, discharge sustaining period, and wall charge erasing period.

In the reset period, first reset pulses RPx and RPy each having a long time constant are applied to all row electrodes in pairs in order to initialize all pixels. Then, second reset pulses RPx2 are applied to all row electrodes.

By the first reset pulse having a long time constant, reset discharge is weakened, thereby improving the contrast of the image. In addition, by applying the second reset pulse, the amount of wall charge becomes equal to each other in all pixels.

In the address period, pixel data pulses DP1–DPn corresponding to the pixel data for every row are applied to the column electrodes as address electrodes D1–Dm in order in accordance with pixel data. At that time, scanning pulses SP are applied to the row electrodes Y1–Yn in order in synchronism with the timings of the pixel data pulse DP1–DPn.

Furthermore, priming pulses PP are applied to the row electrodes Y1–Yn, immediately before the scanning pulses SP are applied, so as to cause the reformation of the priming particles.

In the discharge sustaining period, a discharge sustaining pulse IPx is applied to the row electrodes X1–Xn, and a discharge sustaining pulse IPy is applied to the row electrodes Y1–Yn at offset timing from the discharge row pulses IPx.

During the discharge sustaining pulses are continuously applied, the pixel which holds the wall charge sustains the discharge and emission of light (A discharge sustaining period).

In the discharge sustaining period, a first pulse of the discharge sustaining pulse IPx is set to have a pulse width wider than the subsequent pulses and the discharge sustaining pulse IPy.

In the example of FIG. 3, the application timing of the discharge sustaining pulse is adjusted by the manual adjusting means, so that the fall period a of the discharge sustaining pulse IPx is approximately coincided with a fall period c of the discharge sustaining pulse IPy, and a rise period b of the pulse IPx is approximately coincided with a fall period d.

By adjusting the application timing of the discharge sustaining period as above described, the voltage applied to the row electrodes X and Y in pairs increases, and the rising becomes steep. Consequently, the discharge light emission is intensified and luminance can be increased.

As another example in the waveform of FIG. 3, the fall period a of the pulse IPx and the rise period of the pulse IPy may partially be overlapped, and the rise period b of the pulse IPx and the fall period of the pulse IPy may partially be overlapped. In such a case, since rising of the voltage applied to the electrodes X, Y in pairs becomes gentle, discharge cells disperse in discharge timing. Therefore, it is possible to suppress a peak current.

In FIG. 4, the application timing of the discharge sustaining pulse is adjusted by the manual adjusting means 13 in such a manner that one of the pulses IPx and IPy rises immediately after the falling of the other pulse IPx or IPy.

In the example of FIG. 5, the application timing of the discharge sustaining pulse is adjusted by the manual adjusting means 13 in such a manner that one of the pulses IPX and IPy falls immediately after the rising of the other pulse IPx or IPy.

In the driving waveform of FIGS. 4 and 5, since rising of the voltage applied to the electrodes X, Y in pairs becomes more gentle, discharge cells disperse in discharge timing. Therefore, it is possible to the suppress of effect for a peak current is more improved.

As another adjusting method, the pulse width is set to a proper condition by shifting the rising edge and/or falling edge of the discharge sustaining pulse SP. The pulse width of each of the first reset pulses RPx1, RPy, second reset pulse RPx2, priming pulse PP, scanning pulse SP may be set to a proper condition by shifting the rising edge and/or falling edge of the discharge sustaining pulse SP. By such an adjustment, it is possible to optimize the address margin of each PDP.

Figure 6:
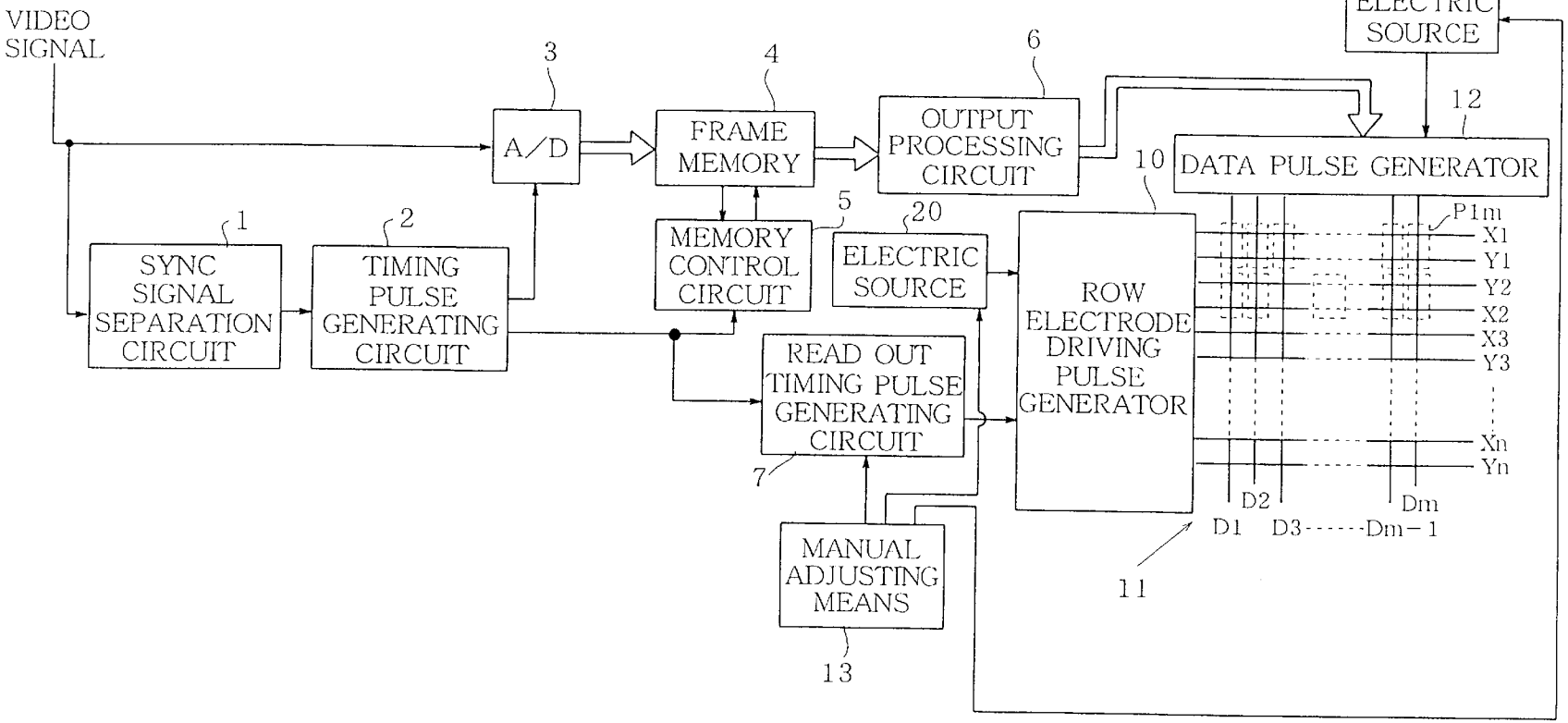
FIG. 6 is a block diagram of a second embodiment of the present invention.

FIG. 6 shows the second embodiment of the present invention. The same parts as the first embodiment of FIG. 2 are identified by the same reference numerals.

The second embodiment is different from the first embodiment in that the pulse width of at least one of pulses of the reset pulse, priming pulse, scanning pulse, pixel data pulse and discharge sustaining pulse can also be manually adjusted for each PDP by the manual adjusting means 13.

Figure 7:
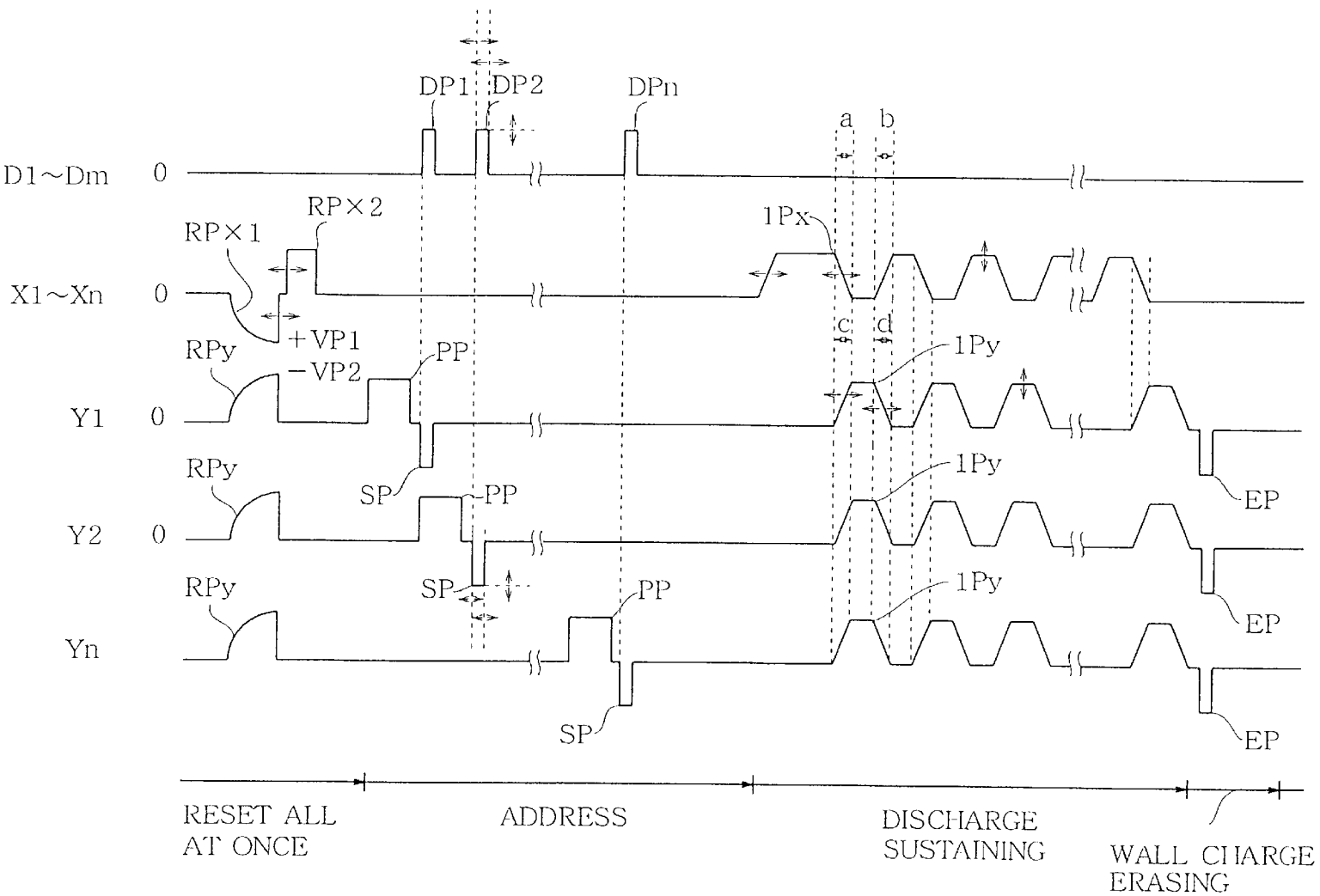
FIG. 7 is time charts of a fourth example.
Figure 8:
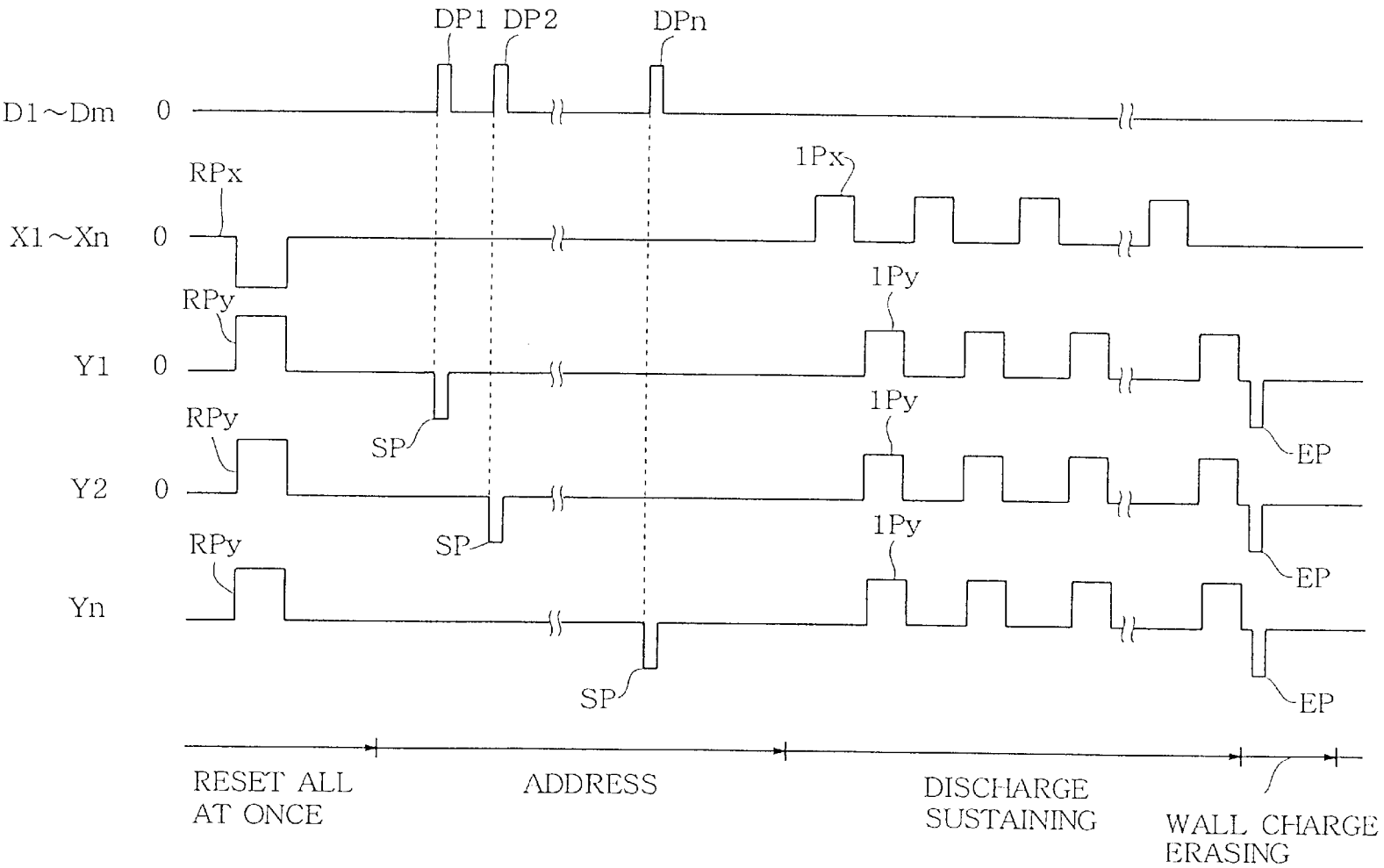
FIG. 8 is time charts showing drive signals for a conventional plasma display panel.

Namely, in the system, adjusting signals are fed to electric source devices 20 and 21, so that the values of voltage (amplitude) applied from the source devices to the row electrode driving pulses generating circuit 11 and the pixel data pulse generating circuit 12 are changed. Thus, the values of voltage (amplitude) of the reset pulse, priming pulse, scanning pulse, pixel data pulse and discharge sustaining pulse are optimized for each PDP (see FIG. 7).

As described above, by adjusting the voltage between row electrodes X and Y, and the voltage between the column electrode and row electrode in the reset period, address period, discharge sustaining period, and others, luminance, address margin, etc. are optimized for each PDP.

Although the embodiment of FIGS. 3 to 5 and 7 are applied to the selective erase address method, the present invention can be applied to the selective write address method. In the selective write address method, the reset pulses are applied to all row electrodes to accumulate wall charges in all pixels, erasing pulses are applied to all pixels to erase the wall charges to initialize all pixels, scanning pulses are applied to one of row electrodes in pairs, and pixel data pules are applied to column electrodes to select lighting pixels and non-lighting pixels.

In accordance with the present invention, the row electrode driving pulse and/or the pixel data pulse each having a proper amplitude are applied at a proper rise timing, and fall timing for each PDP. Therefore, it is possible to improve the display characteristic suitable for each PDP and to improve the yield of the product.

While the invention has been described in conjunction with preferred specific embodiment thereof, it will be understood that this description is intended to illustrate and not limit the scope of the invention, which is defined by the following claims.

What is claimed is:

1. A driving system for a plasma display panel having a plurality of row electrodes in pairs, a plurality of column electrodes intersecting with the row electrodes, first driving means for applying a row electrode driving pulse to each of the row electrodes, and second driving means for applying a pixel data pulse to each of the column electrodes, comprising:

a manual adjusting means for manually adjusting a rise edge time point and/or a fall edge time point of the row electrode driving pulse and/or the pixel data pulse, wherein the manual adjusting means is operated in such a manner that a fall period of a discharge sustaining pulse applied to one of the row electrodes in pairs coincides with a rise period of the discharge sustaining pulse applied to the other row electrode, and wherein the display characteristics of the plasma display panel is optimally adjusted in accordance with the plasma display panel.

2. The system according to claim 1, wherein the row electrode driving pulse includes reset pulses applied to the row electrodes in pairs for initializing all pixels, scanning pulses applied to one of the pair of row electrodes in order, discharge sustaining pulses applied to the row electrode in pairs.

3. The system according to any one of claims 1 to 2, wherein the manual adjusting means is provided for further adjusting a pulse width of the row electrodes driving pulse and/or the pixel data pulse.

4. The system according to any one of claims 1 to 3, wherein the manual adjusting means is provided for further adjusting a pulse amplitude of the row electrode driving pulse and/or the pixel data pulse.

5. A driving system for a plasma display panel having a plurality of row electrodes in pairs, a plurality of column electrodes intersecting with the row electrodes, first driving means for applying a row electrode driving pulse to each of the row electrodes, and second driving means for applying a pixel data pulse to each of the column electrodes, comprising:

a manual adjusting means for manually adjusting a rise edge time point and/or fall edge time point of the row electrode driving pulse and/or the pixel data pulse, wherein the manual adjusting means is operated in such a manner that a fall period of a discharge sustaining pulse applied to one of the row electrodes in pairs partially coincides with a rise period of the discharge sustaining pulse applied to the other row electrode, and wherein the display characteristics of the plasma display panel is optimally adjusted in accordance with the plasma display panel.

6. A driving system for a plasma display panel having a plurality of row electrodes in pairs, a plurality of column electrodes intersecting with the row electrodes first driving means for applying a row electrode driving pulse to each of the row electrodes, and second driving means for supplying a pixel data pulse to each of the column electrodes, comprising:

a manual adjusting means for manually adjusting a rise edge time point and/or fall edge time point of the row electrode driving pulse and/or the pixel data pulse, wherein the manual adjusting means is operated in such a manner that a discharge sustaining pulse applied to one of the row electrodes in pairs rises immediately after the falling of the discharge sustaining pulse applied to the other row electrode, and wherein the display characteristics of the plasma display panel is optimally adjusted in accordance with the plasma display panel.

7. A driving system for a plasma display panel having a plurality of row electrodes in pairs, a plurality of column electrode intersecting with the row electrodes, first driving means for applying a row electrode driving pulse to each of the row electrodes, and second driving means for applying a pixel data pulse to each of the column electrodes, comprising:

a manual adjusting means for manually adjusting a rise edge time point and/or a fall edge time point of the row electrode driving pulse and/or the pixel data pulse, wherein the manual adjusting means is operated in such a manner that a discharge sustaining pulse applied to one of the row electrodes in pairs falls immediately after the rising of the discharge sustaining pulse applied to the other row electrode, and wherein the display characteristics of the plasma display panel is optimally adjusted in accordance with the plasma display panel.

* * * * *